United States Patent [19]

Bogar

[11] Patent Number: 4,711,469

[45] Date of Patent: Dec. 8, 1987

[54] BOOKCOVER AND BINDING METHOD

[76] Inventor: Gerald D. Bogar, 111 Ramble La., Suite 105, Austin, Tex. 78745

[21] Appl. No.: 884,477

[22] Filed: Jul. 11, 1986

[51] Int. Cl.[4] ..... B42D 1/00

[52] U.S. Cl. ..... 281/25 A; 281/15 R; 412/4; 412/6

[58] Field of Search ..... 281/15 R, 21 R, 21 A, 281/25 R, 25 A, 29; 282/29 B; 412/4, 6, 33, 39

[56] References Cited

FOREIGN PATENT DOCUMENTS

| | | | |
|---|---|---|---|
| 252767 | 10/1948 | Switzerland | 281/21 A |
| 466752 | 5/1937 | United Kingdom | 281/25 A |
| 566561 | 1/1945 | United Kingdom | 282/29 B |

*Primary Examiner*—Paul A. Bell

*Attorney, Agent, or Firm*—Arnold, White & Durkee

[57] ABSTRACT

A book and book binding method are provided which yields a book having a flat spine which is easily printed during binding. Advantageously, the book includes a mechanical binding passing through the exterior at four locations which strengthens the binding, and yet allows unrestricted movement of the exterior and pages through a 180° arc. The book includes front and back exterior sections, each section having adjoining cover, margin and spine tab. The mechanical binding extends through aligned holes in the back and front covers and intervening pages, and through the aligned holes of the front and back margins. The front and back spine tabs are adhesively overlapped to form a generally flat spine. The binding method is particularly advantageous in that the exterior is easily printed before binding and permits a printed flat spine.

15 Claims, 7 Drawing Figures

Fig. 4
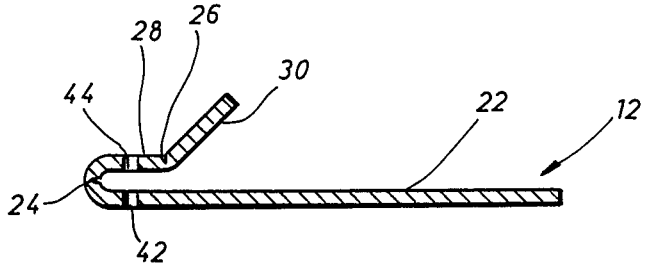
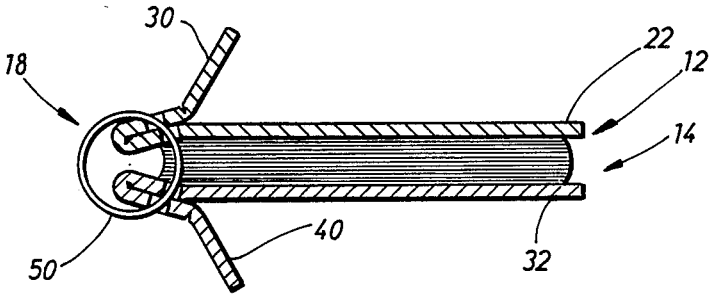
Fig. 5
Fig. 6
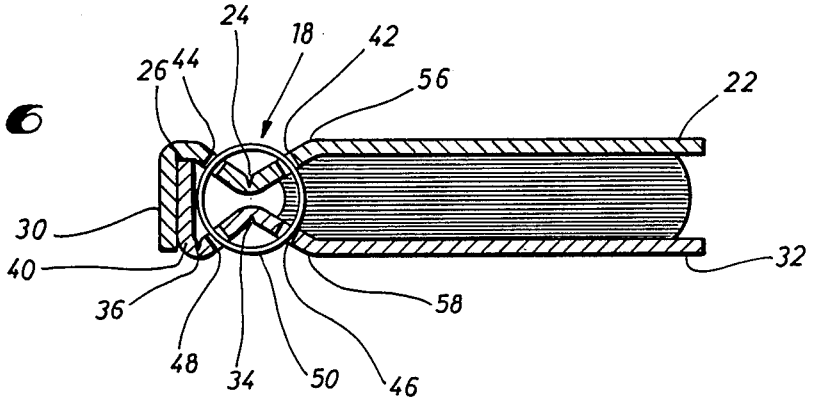
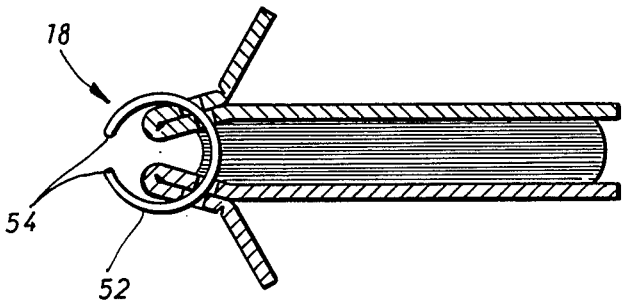
Fig. 7

BOOKCOVER AND BINDING METHOD

BACKGROUND OF THE INVENTION

1. Field of the Invention

This invention relates to a mechanically bound book having an exterior which wraps around the pages and presents a flat spine. In addition, the present invention relates to a method for binding such a flat-spined, mechanically bound book.

2. Description of the Related Art

There are many choices available for binding a book and each choice presents its own advantages and disadvantages over competitive binding processes. For example, case binding is appropriate for high-quality, hard cover books, but is fairly expensive and generally appropriate for large volume production run, relatively high priced books. Saddle stitching and perfect binding represent a low cost alternative to case binding and are often used in high volume, high speed production.

A major disadvantage of such typical high volume bindings is that the bound books cannot be opened to lay flat. There are many different types of books in which it is important that the bound book can be opened and will lay flat. For example, calendars, cookbooks, diaries, appointment books, exercise books and notebooks. In addition, computer manuals are an important new category of books in which the user demands a book that will lay flat when opened. In such uses where it is necessary that the book lay flat, "mechanical binding" has become popular.

Mechanical binding is generally regarded as a binding process which uses a mechanical device to secure the pages on the cover of the book without the use of gluing, stitching, or sewing. Mechanical binding is particularly advantageous in that such books, when opened, will lay flat. Mechanical binding is somewhat at a disadvantage in that it is costly; however, mechanical binding can be efficiently utilized in low volume production runs.

"Mechanical binding" usually refers to books having as binding elements: (1) a continuous length of metal or plastic wire; or (2) cut and formed plastic combs. Plastic combs are useful for very low volume applications where the pages and cover are punched and the comb attached by hand. On the other hand, wire binding (either metal or plastic) is more adept for automated operation. There are many different types of wire binding, with the spiral wire or double loop type being the most popular. The double loop (sometimes referred to as "open loop" or "double wire") has some advantages over spiral wires in that it maintains registration of the pages cross the gutter. This might be an important feature where a large number of illustrations are involved in the book. Many types of double loop bindings are available, such as "Wire-O" and "Double-O" from James Burn International, Poughkeepsie, New York. "Wire-O" basically takes a C-shaped wire from a spool, cuts it to proper length, and binds it into the sheet holes.

The spiral type wire bindings basically involve either metal wire or plastic coil devices which use a special, belt or roller driven spiraling machine to thread the coil through the holes punched in the book. There are many different types of such spirals, such as "Plastikoil" manufactured by Gateway Publishing Co., Ltd. of Manitoba, Canada.

While these various types of mechanical bindings are advantageous in that when opened, such mechanically bound book will lay flat, nevertheless, a major disadvantage is the appearance of the spine of such books. That is, many users desire a spine on which information can be printed to identify the book when it is on the shelf. While some of the mechanical binding devices, such as the plastic combs, can be printed (such as by screen printing) this is an expensive and difficult process. Further, most of the mechanical binding devices that present a spine surface for printing, to some degree restrict the opening of the book. Further, some of the mechanical binding devices are not as sturdy as necessary for regular use. When the environment for a typical mechanically bound book is considered—such as heavily used cook books, computer manuals, etc.—then the necessity of mechanical binding to provide a structure compatible with heavy usage is readily appreciated.

One approach has been to use a mechanical binding, such as a spiral wire or loop, to secure the book contents to the back cover. In such a book, the binding typically connects to the back cover at two locations and the front cover wraps around the contents. The resulting book is deficient in that the front cover is loose or "floppy" relative to the contents, and additionally, is easily collapsed if stacked. Thus, such a book is not particularly well suited for heavy usage.

Therefore, it would be a significant advance in the art if a mechanically bound book were devised which not only withstood heavy usage, but provided a rigid, flat spine which was easily printed using conventional printing techniques.

SUMMARY OF THE INVENTION

The problems outlined above are largely solved by the book and binding method of the present invention. That is, the book of the present invention presents a generally flat spined book in which the exterior wraps around the pages to present a flat spine which can be conventionally printed. The binding is durable and intersects the exterior in four locations to provide a mechanically bound book which will not only lay flat when opened, but will withstand heavy usage.

Broadly speaking, the flat-spined book hereof presents an exterior presenting interconnected front and back sections, with a mechanical binding device coupling the pages to both the front and back sections. Each section presents a cover, crease, attachment margin, score and spine tab. The spine tabs of the front and back sections overlap to form the reinforced flat spine of the book. A plurality of holes extend through the front and back covers and the front and back attachment margins, the holes being generally parallel and proximate to the creases. The mechanical binding device extends through the operatively aligned holes in the front and back cover and through the operatively aligned holes in the front and back attachment margins, such that the binding device extends through the exterior in four locations.

The method of binding a book in accordance with the present invention provides as a starting material a rectangular, flat, exterior sheet having two adjoining sections, each section having rectangular, serially adjoining, cover, margin and spine tabs. The binding steps comprises: creasing the sheet between each cover and margin, scoring the sheet between each margin and spine tab, and cutting the sheet to separate the two sections. Holes are punched through each margin and cover and the sections overlayed with the holes of the covers and margins of the two sections in operative alignment. The mechanical binding device is inserted through the aligned holes of the covers and margins to interconnect the sections at four locations. The spine tabs are overlapped and adhesively secured to each other to form a generally flat spine on the book.

Typically, a filler material, such as pages having holes punched along the side margin, is inserted between the covers such that the holes of the two covers and pages are operatively aligned for receiving the mechanical binding device. Advantageously, the exterior sheet can be printed before binding such that printing will appear not only on the covers, but additionally on the flat spine. In the preferred method, each section is folded along the crease in accordian fashion with the margin adjoining the cover, such that a single punching operation forms the holes in both the margin and cover. Additionally, the accordian fold allows the mechanical binding device to be easily inserted through the aligned holes, with the margins folded away from the covers to overlap the spine tabs.

BRIEF DESCRIPTION OF THE DRAWINGS

FIG. 4 is a sectional view of one section of the exterior sheet at an intermediate stage of binding;

FIG. 5 is an end elevational view of a spiral bound book at an intermediate stage of binding;

FIG. 6 is an end elevational view of a completed bound book in accordance with the present invention; and FIG. 7 is an alternative embodiment of the book of the present invention, similar to the view of FIG. 5, using a "Wire-O" binding device.

DESCRIPTION OF THE PREFERRED EMBODIMENTS

Figure 1:
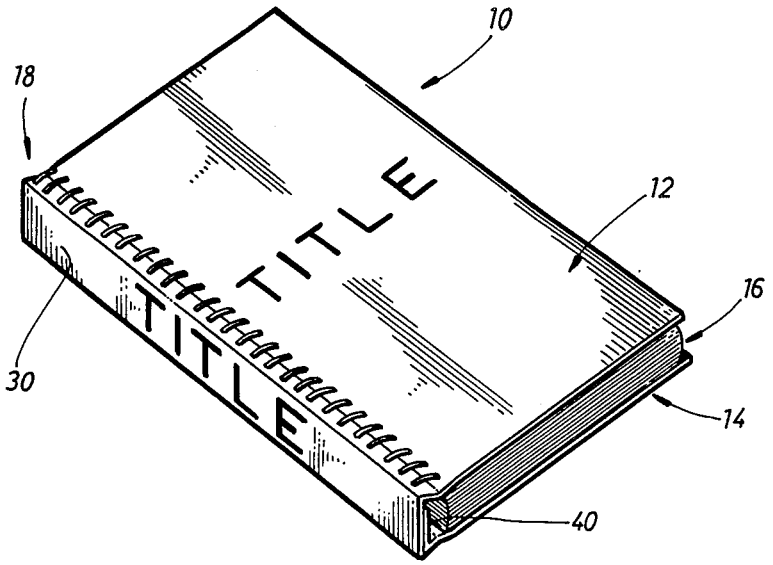
FIG. 1 is a perspective view of a mechanically bound, flat-spined book in accordance with the present invention.

Turning now to the drawings, a book 10 in accordance with the present invention is broadly illustrated. Generally speaking, the book 10 presents exterior sheet 11 which includes interconnected front and back sections 12, 14, with a plurality of pages 16 received therebetween. As shown in FIG. 1, a mechanical binding device 18 interconnects front and back sections 12, 14 and pages 16.

Figure 2:
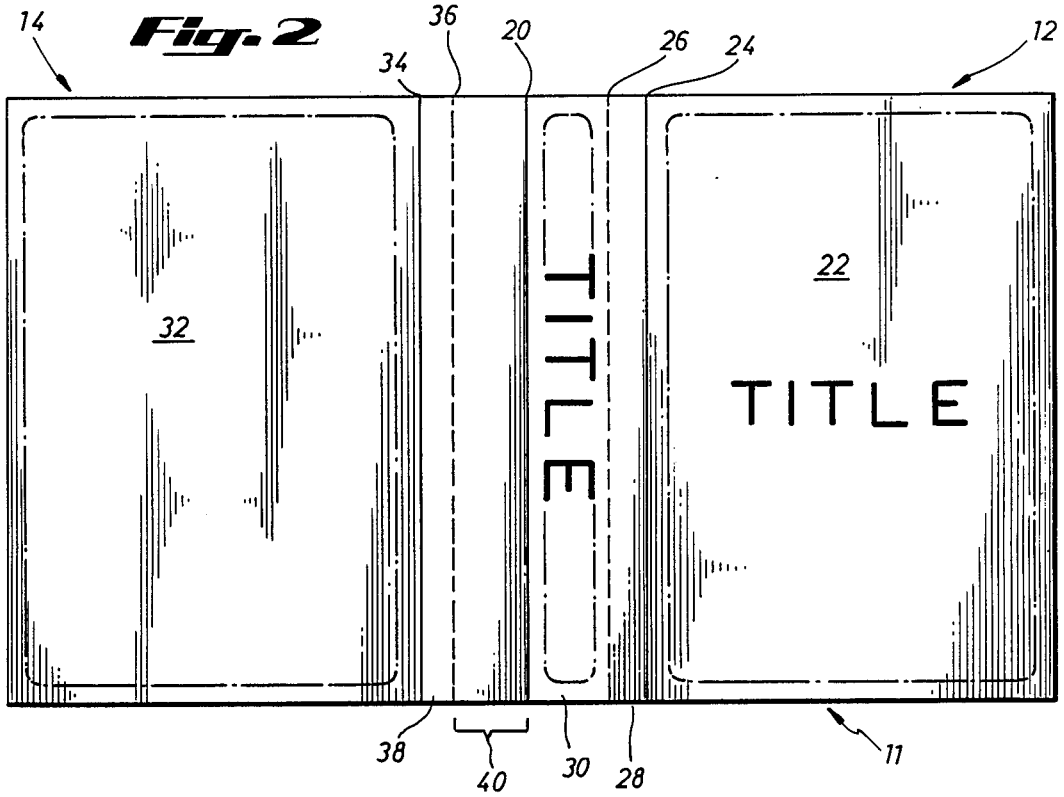
FIG. 2 is a plan view of the exterior sheet of the book, and particularly illustrates the layout.
Figure 3:
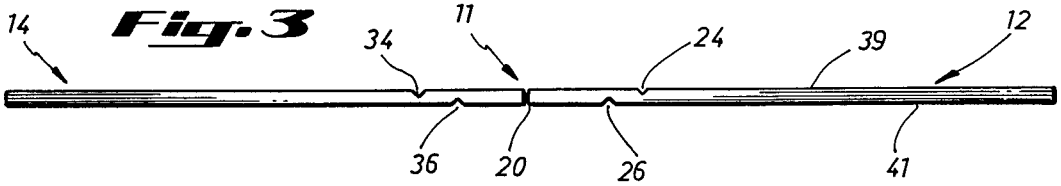
FIG. 3 is a side elevational view of the exterior sheet illustrated in FIG. 2.

In more detail as illustrated in FIGS. 2 and 3, the exterior sheet 11 is divided into front and back sections 12, 14 along cut line 20. The front section 12 broadly includes rectangular cover 22 having one marginal edge adjacent the rectilinear crease 24. A rectilinear score line 26 runs parallel to the crease line 24 remote from the cover 22 to generally define the rectangular attachment margin 28 between the crease 24 and score 26. Rectangular spine tab 30 is defined between the score 26 and cut line 20. The back section 14 is nearly identical to the front section 12, and accordingly presents serially adjoining cover 32, crease 34, score 36, attachment margin 38, and spine tab 40.

As shown in FIG. 2, a printing region is generally outlined on the front and back covers 22, 32 and on the front spine tab 30 (ordered region as illustrated in the drawing). As illustrated in FIGS. 1 and 6, the front spine tab 30 is adhesively secured to the back spine tab 40. For convenience, exterior sheet 11 is labeled in FIG. 3 as having a top 39 and bottom 41.

Turning to FIGS. 1 and 4–7, it can be appreciated that in the preferred embodiment a plurality of holes 42 are disposed through the cover 22 in a rectilinear fashion generally parallel to the crease 24. Similarly, a plurality of holes 44 extend through the attachment margin 28 parallel and a rectilinear fashion to both the crease 24 and score 26 (see in particular, FIG. 4). As can be appreciated from FIGS. 5–7, the back section 14 in similar fashion presents holes 46 extending through the back cover 32, and holes 48 extending through the back attachment margin 38.

In the preferred embodiment illustrated in FIGS. 1–6, the mechanical binding device 18 is a plastic spiral wire coil 50 such as made by Plastikoil of Gateway Publishing Co., Ltd., Winnepeg, Canada. FIG. 7 represents a configuration of the book 10 nearly identical to that illustrated in FIG. 5, with the exception of the material comprising the mechanical binding device 18. In FIG. 7, a wire loop 52 ("Wire-O") binding device is illustrated. FIG. 7 shows the wire loop 52 in the open configuration, with the two ends 54 being crimped together to form a continuous loop for completing the binding device. It will be appreciated that many different types of mechanical binding devices 18 are suitable for use within the scope of the present invention.

Method of Binding

Broadly speaking, in the preferred method the exterior sheet 11 illustrated in FIG. 2 is layed-out according to the size and thickness of the book 10. Advantageously, as illustrated in FIG. 2, the exterior sheet 11 may be printed using standard printing techniques before binding the pages. This is particularly advantageous in that not only the covers 22, 32 may be printed, but additionally, the spine tab 30 may be printed so that the book 10 will appear as illustrated in FIG. 1.

Following printing, the entire exterior sheet 11 is first scored along crease lines 24, 34 (preferably on top 39) and then scored to form score lines 26, 36 (on bottom 41). As used in the present application, the terms "crease," "score," "fold," and "hinge," are used somewhat interchangeably in that crease lines 24, 34 are, for example, operative whether formed by a scoring, folding, or other fabrication process. Of course, in the preferred embodiment illustrated in FIG. 3, crease lines 24, 34 and score lines 26, 36 are preferably formed by scoring for ease of fabrication. During or following the scoring operation, the front and back sections 12, 14 are separated by cutting the exterior sheet along cut line 20 as more fully illustrated in FIG. 3.

FIG. 4 broadly illustrates the punching process. In the preferred punching process, the attachment margin 28 is folded back towards the cover 22 along the crease line 24 into adjoining relation. A single pass of a punching template then forms the holes 42, 44, with the back section 14 punched in a similar procedure. It will be readily seen that many viable alternatives exist—for example the front and back sections 12, 14 may be folded along crease lines 24, 34 in accordian fashion and juxtaposed so that a single punching pass forms holes 42,44,46, and 48. Further, in some automated presses, it will be seen that punching may be accomplished on the flat exterior sheet 11 during the scoring and cutting fabrication steps (see FIG. 3).

In the preferred method, after the front and back sections 12, 14 have been punched, and then foraminated pages 16 inserted therebetween, the mechanical binding device 18 is inserted. In FIGS. 5–6, the plastic coil 50 is inserted using a commercially available belt driven spiraling machine. The wire loop 52 ("Wire-O") illustrated in FIG. 7 is easily inserted and crimped using crimping tools (e.g. produced by James Burn International Co., Ltd., Han Sickinger, or Renz).

In final fabrication, the attachment margins 28, 38 and spine tabs 30, 40 are folded from their position adjacent the covers 22, 32 outwardly away such that the spine tab 30 overlays the spine tab 40 (or vice versa). It will be appreciated that adhesive is applied to one or both of these spine tabs 30, 40 at some point during fabrication so that the spine tabs 30, 40 are adhesively secured after overlay. The type of adhesive is determined by the thickness and size of the book, the type of cover material, the intended use of the book, the stage of application, and the method of application. In several applications, it has been found that 3M A-25 and A-60 acrylic adhesives series, in particular Type Y-9485, Y-926, Y-920, and Y-969 as manufactured by 3M Industrial Specialties Division work well in adhesively securing the spine tabs 30, 40 to form an integral, flat, spine.

It may be appreciated from careful comparison of FIGS. 5 and 6, that the book 10 illustrated in FIG. 6 is slightly thicker than the book 10 illustrated in FIG. 5. In an alternative embodiment, particularly for thicker books, rectilinear hinge lines 56, 58 may be formed in the front and back covers 22, 32 to give the book a sharper appearance and make it easier to use when new. The hinge line 56 is rectilinear and parallel to the crease 24 with the holes 42 generally spaced an equal distance between the crease line 24 and hinge line 56 (hinge line 58 is similarly placed in back cover 32).

EXAMPLE

It should be readily apparent from the description of the book and method of the present invention that the exterior layout lends itself for easy make-ready for both the printing and binding processes. In the layout of FIG. 2, the "width" of the book 10 or section is generally referred to as the dimension in the left/right direction, while the "length" refers to the bottom/top direction.

In general (for books and devices 18 of typical size), the width of the front section 12 (right of line 20 in FIG. 2) and the width of the back section 14 (left of cut line 20 in FIG. 2) should be approximately the width of the finished book plus 6 millimeters. The widths of the attachment margins 28, 38 typically range between 8–14 millimeters, and as illustrated in FIG. 4 can be viewed as the hole punch area. The length of the book 10 (e.g. the length of the cut line 20) is generally two or three millimeters longer than the page spine length.

It should be appreciated that the exact position of the holes 42, 44, 46, 48 depends upon whether a wire spiral, such as the plastic coil 50 is being used, or whether a wire loop 52 such as "Wire-O" is being used. For the wire loop 52, the holes 42,44,46,48 do not have to compensate for the pitch of the coil or spiral. Similarly, when the book 10 is open, the juxtaposed pages are in general registration. However, when a spiral or coil is used, the pitch of the spiral or coil must be slightly compensated for. This compensation is easily made and is primarily dependent on the pitch and size of the coil 50 used.

I claim:

1. A book comprising:

an exterior having interconnected front and back sections;

a plurality of pages received generally between said sections;

mechanical binding means for coupling the pages to both the front and back sections;

each section comprising a relatively enlarged, generally rectangular cover, a generally rectilinear crease portion adjoining an edge of the cover, a generally rectangular attachment margin adjoining said crease portion, a generally rectilinear score portion adjoining an edge of said attachment margin, a generally rectangular spine tab adjoining said score portion, the cover, crease, margin, score, and spine tab being serially spaced in generally parallel relation, the cover and margin each having a plurality of spaced-apart holes therethrough generally parallel to the crease portion; and the holes in the front and back cover being operatively aligned, and the holes in the front and back attachments margins being operatively aligned, for receiving the mechanical binding means through the aligned holes such that the mechanical binding means passes through the front and back covers and front and back attachment margins of the exterior, and the spine tabs being overlapped and adhesively secured to each other to form a rigid, flat spine adjacent the mechanical binding means.

2. The book according to claim 1, each cover including a generally rectilinear hinge line generally parallel and proximate to said crease portion.

3. The book according to claim 2, the holes extending through each cover being located in the region between the hinge line and crease portion.

4. The book according to claim 1, the pages having a plurality of holes with the pages received generally between the covers, with the page holes and cover holes in operative alignment for receiving said binding means extending therethrough.

5. The book according to claim 1, said mechanical binding means comprising an elongated, helical spiral coil threadingly received through said holes.

6. The book according to claim 1, said mechanical binding means comprising a tube-like, open-loop design.

7. The book according to claim 1, said cover and margin holes being respectively spaced from the crease portions, and said mechanical binding means dimensioned, such that the book is operable between a closed configuration with the pages generally received between the covers in overlapping relation, and an open configuration in which the front and back covers are juxtaposed and the pages are receivable on either cover and will remain positioned overlying such cover in a generally flat condition.

8. A method of binding a book, comprising the steps of:

providing a generally rectangular, flat, exterior sheet having a top and a bottom, and including adjoining sections, each section having serially adjoining, generally rectangular, cover, margin and spine tab;

creasing the sheet between each cover and margin to form crease lines;

scoring the sheet between each margin and spine tab to form score lines;

cutting the sheet between each section;

folding each section along the crease line in accordian fashion with the margin folded adjacent the cover;

punching a plurality of holes through each margin and cover;

overlying the sections with the holes of the respective cover and the holes of the respective margins in operative alignment;

inserting a mechanical binding system through the aligned holes of the covers and margins to interconnect the sections at four locations;

folding the margins away form the respective covers with the mechanical binding system inserted;

overlapping the spine tabs;

adhesively securing the overlapped spine tabs to form a flat spine on the book.

9. The method according to claim 8, including the step of:

printing the exterior sheet.

10. The method according to claim 8, including the step of:

inserting a plurality of pages having a plurality of holes along one edge, with the holes of the pages and the holes of the covers in operative alignment.

11. The method according to claim 10, including the step of:

inserting a plurality of pages between each section prior to said punching step, said punching step including punching holes in said pages and through the margin and cover.

12. The method according to claim 8, including the step of:

trimming the sections before the sheet cutting step.

13. The method according to claim 8, including the step of:

forming a rectilinear hinge line in each cover parallel to the crease line, with the cover holes disposable between the hinge line and crease line.

14. The method according to claim 8, including the steps of:

creasing the sheet on the top; and scoring the sheet on the bottom.

15. A bookcover comprising:

front and back interconnected sections of generally rigid material, each section having a flat spine tab, a margin adjoining the spine tab, and a cover separated from the margin by a crease line;

a plurality of holes in each margin and cover;

mechanical binding means extending through the holes in the margins and covers for interconnecting the sections, the cover and margin of each section being operable to shift relative to each other along said crease line to allow opening and closing of the cover, the spine tabs being overlapped and adhesively secured to each other to form a rigid, flat spine adjacent the mechanical binding means.

* * * * *